United States Patent [19]

Ginzburg et al.

[11] Patent Number: 4,722,212

[45] Date of Patent: Feb. 2, 1988

[54] SELF-COMPENSATING ROLL

[75] Inventors: Vladimir B. Ginzburg, Pittsburgh; Remn M. Guo, Monroeville, both of Pa.

[73] Assignees: United Engineering Rolling Mills, Inc.; International Rolling Mill Consultants Inc., both of Pa.

[21] Appl. No.: 795,577

[22] Filed: Nov. 6, 1985

[51] Int. Cl.[4] ..... B21B 27/02; B21B 29/00

[52] U.S. Cl. ..... 72/241; 29/110; 72/199

[58] Field of Search ..... 72/241, 242, 243, 237, 72/199; 29/110

[56] References Cited

U.S. PATENT DOCUMENTS

| | | | |
|---|---|---|---|
| 749,679 | 1/1904 | Johnson | 72/237 X |
| 2,187,250 | 1/1940 | Sendzimir | 72/242 |
| 4,407,151 | 10/1983 | Gronbech | 72/241 |

FOREIGN PATENT DOCUMENTS

| | | | |
|---|---|---|---|
| 0068206 | 4/1982 | Japan | 72/243 |

OTHER PUBLICATIONS

"Strip Profile Control with Flexible Edge Backup Rolls," by Vladimir B. Ginzburg, pp. 1 through 31, with FIGS. 1 through 25 and Tables 1-3.

*Primary Examiner*—Robert L. Spruill
*Assistant Examiner*—Steve Katz
*Attorney, Agent, or Firm*—Arnold B. Silverman; Suzanne Kikel

[57] ABSTRACT

A self-compensating roll for rolling various width strip-like material wherein the roll is subject to non-uniform rolling load distribution between its opposite ends during rolling. The roll comprises a cylindrical roll body and outer material contacting surface. Outwardly extending displaceable members are formed beneath the contacting surface in the roll body at the opposed ends of the roll which permit the outer contacting surface areas to be displaced in a direction away from the direction the axial portion of the roll body deflects under a given load.

4 Claims, 7 Drawing Figures

SELF-COMPENSATING ROLL

BACKGROUND OF THE INVENTION

Figure 1:
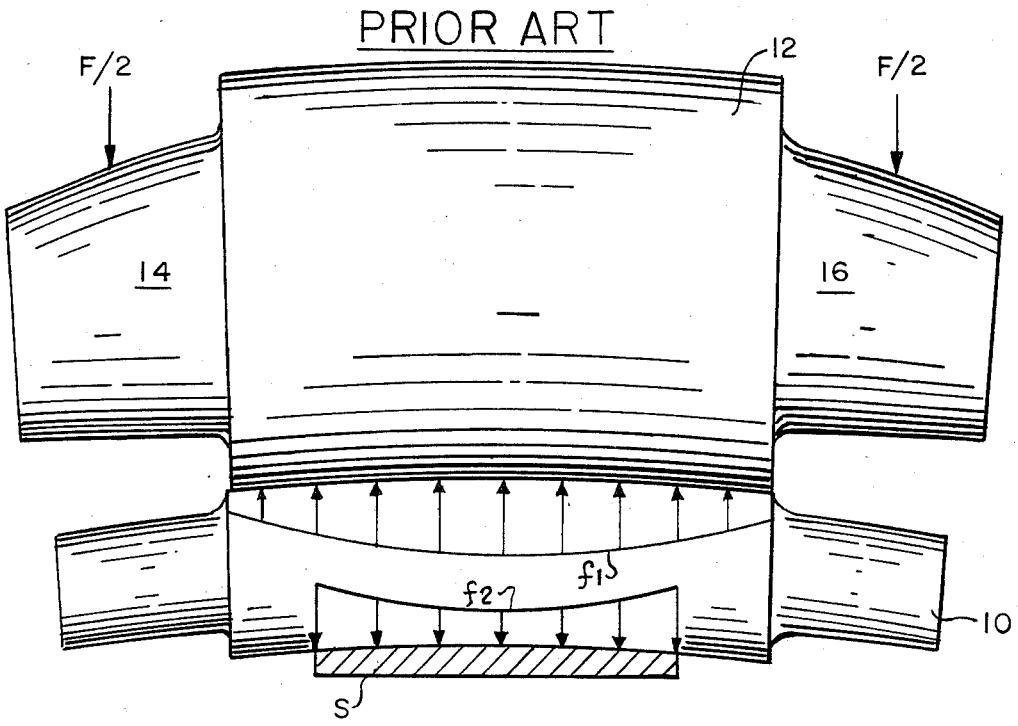

This invention relates to an improved roll for use with machinery for processing flat rolled products wherein objectionable load created deflections are self-compensated.

In the rolling of flat rolled strip-like products, such as hot and cold carbon steel strip, rubber, plastics, paper and the like the rolls that are employed to process the material deflect between their oppositely held ends when the center portion of the roll is engaged by the material. This deflection results in unacceptable product conditions due to its affect on the uniformity of the cross section i.e., profile and flatness of the strip and edge reduction (edge drop) and the inability to satisfactorily correct these conditions.

In the past, and particularly in the rolling mill industry to which for purposes of explaining the invention reference will hereinafter be made, attempts have been made to eliminate some or all of these adverse conditions during the rolling process. These attempts included roll bending in combination with a predetermined machine roll crown, employment of special shaped work rolls and/or back up rolls including fluid expandable rolls, shiftable rolls and thermal roll crown control, etc.

To better appreciate the present invention and also to serve as background information for a better understanding thereof two particular prior art forms will be more fully referred to. First, is the disclosure of U.S. Pat. No. 4,299,109 where there is shown a sleeve shifting device having a solid arbor and loose outer sleeve of the backing up roll construction, the sleeve being shiftable to attempt to reduce deflection of the portion of the work rolls extending beyond the edges of the strip being rolled. The second prior art form has reference to U.S. Pat. No. 4,407,151 which illustrates a internal shifting arbor of a backing up roll construction which attempts to accomplish the same result as the first noted prior art arrangement. In the present invention the arbor and sleeve, in the form of a two piece construction, is rigidly secured to each other to achieve the same objectives of the two prior art forms by the appropriate configuration of the sleeve geometry designed to cover a wide range of width strips.

However, none of these attempts have been totally successful, particularly due to the fact of the many variables involved in a normal rolling operation, such as the change on the width of the strips being rolled and degree of reduction from one strip to another, the change in temperature of succeeding strips, and the change in temperature of the strip while being rolled and that of the mill itself.

Another aspect of one of the conditions that gives rise to an unacceptable product, and which represents a principle part thereof, is the constant change that takes place in the shape or contour of the rolling surface of the work rolls of the mill when subject to the constant change in temperature and loading. Even in the case where it is desirable to produce a product with a degree of non-uniform profile, it has been extremely difficult in the past to obtain the required stability of rolling conditions and particularly the shape or contour of the rolling surfaces of the work rolls to obtain the desired profile throughout the strip and from strip to strip.

Also in the past for essentially the same reasons it has been extremely difficult to obtain flat strip i.e. free of buckles and waves and prevent over reduction of the edges by employment of the above-mentioned corrective means and procedures.

The present invention provides at least a substantial solution to these problems in providing a roll which by its very nature will greatly reduce, if not eliminate, roll deflection in the context discussed above thereby creating a flat or if desired, a controlled degree of flatness or profile of a contacting surface of the roll which could be a rolling surface or in the case of a multi high roll arrangement a surface that engages a second roll.

Another aspect of the present invention is to provide a rolling surface that will substantially remain unchanged during the rolling procedure and as a result greatly reduce the degree of external changes that will have to be performed, if any, in order to obtain a flat rolling surface or a controlled contour rolling surface.

A still further object of the present invention is to provide a controlled rolling surface in terms of its contour which in combination with known external means, such as roll bending, will compensate for the adverse affect of roll deflection over rolling conditions having a wide range of variables such as a change in the width or type of strip, amount of reduction, temperature variation, etc.

Figure 4:
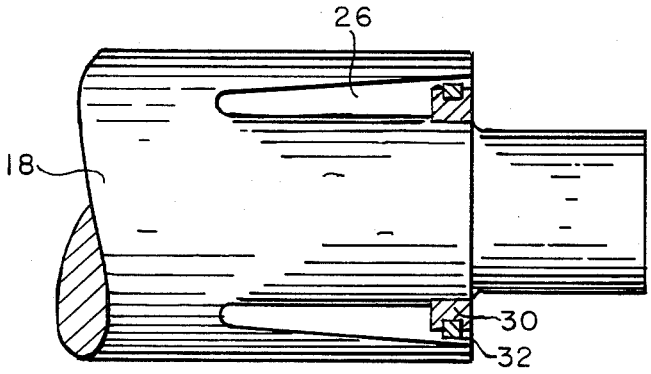
Figure 2:
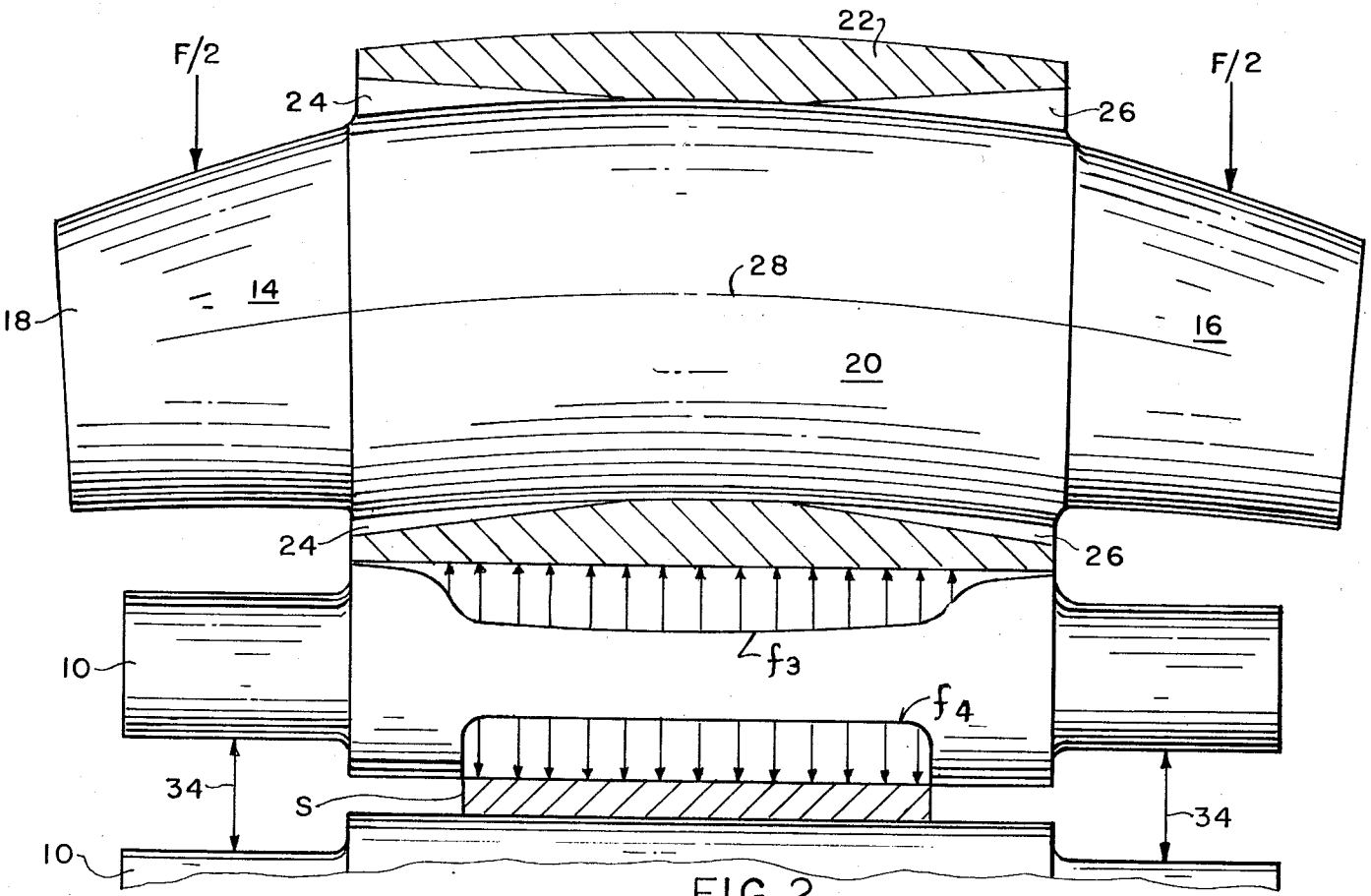

These objects, as well as other features and advantages of the present invention, will be better understood when the following description of the preferred embodiment of the invention is read along with the accompanying drawing which:

FIG. 1 is a schematic view of cooperative work and backup rolls illustrating in exaggerated form the inherent and normal deflection of the rolls under a rolling load according to the prior art, FIG. 2 is a view similar to FIG. 1 illustrating a backup roll constructed in accordance with the present invention, and indicating the interaction between the two rolls resulting in the work roll having a flat rolling surface due to the self compensation of the deflection by the backup roll, and FIGS. 3—A, B, C and D are schematic views somewhat similar to FIG. 2 for the purpose of discussing the design of the roll cavities, and FIG. 4 is a schematic view for the purpose of illustrating stop and seal members incorporated in the roll sleeve.

With reference first to FIG. 1, there is shown a cast iron work roll 10 constructed in a usual manner with its rolling surface engaging strip S. The work roll 10 is also engaged in a usual manner by a cast steel backup roll 12, the journals 14, 16 of which are held by gap setting members such as screwdowns designated by the two symbols F/2, which also suggests that each end of backup roll 12 is resisting one-half of the total rolling force F, required to obtain the desired reduction in the thickness of strip S.

FIG. 1 also illustrates in exaggerated form the normal deflection of both rolls, wherein the work roll 10 being much smaller in diameter and hence substantially less rigid than the backup roll 12, had a deflection dependent on the degree of deflection of the backup roll. Also illustrated is the fact that the deflection of the work roll is imparted to the strip S resulting in unaccceptable characterstics being rolled in the strip, such as non-uniform profile, non-flatness and edge drop. This is due to the non-uniform load distribution during rolling on the work roll 10 as depicted by curve $F_1$ and on the strip S as depicted by curve $F_2$.

Turning now to FIG. 2, which as noted above, schematically portrays a backup roll constructed in accordance with the present invention, similar reference characters will be employed to identify the same elements shown in FIG. 1. Drawing attention to the backup roll 18, in this case it is made up of two separate elements, namely a solid cast alloy iron arbor 20 and a forged alloy steel sleeve 22. The opposite ends of the sleeve 22 are provided with opposite cavities 24, 26. The cavities are generally cylindrical and have an axial shape generally decreasing to a point of disappearance toward the center transverse axis of the sleeve 22 and arbor 20 of the backup roll 18. The sleeve may be secured to the arbor by a well-known shrink-fit process, but other known procedures can be employed if desired. Also it will be appreciated that the backup roll 18 can be an integral solid roll with cavities 24, 26 machined or otherwise formed in the roll so as to provide a "sleeve effect".

The generation of the cavities 24, 26 is carefully performed whereby the sleeve 22 will self-compensate for the deflection of the backup roll to produce a flat or substantially flat contact surface for work roll 10. In this self-compensating the "free" opposite ends of the sleeve under the rolling load are caused to deflect in a direction opposite to the direction they would normally deflect if the cavities were not provided and by an amount substantially equal to the deflection of the arbor to thereby render the contacting surfaces of the two rolls substantially "flat" as shown in FIG. 2 and hence the contacting surfaces between the work roll 10 and strip S will be substantially "flat".

Still referring to FIG. 2, this figure illustrates by a series of parallel force arrows and force curve $F_3$ the distribution of the rolling force effected by strip S. Also illustrated is the reaction of sleeve 22 to the rolling force, whereby the portions of cavities 24 and 26 and particularly the outer ends adjacent work roll 10 are deflected inwardly i.e., towards the axis of the backup roll under the rolling force in a manner to maintain the outer surface of the sleeve 22 on the area of the width of the strip S "flat" wherein it will not follow the deflection of the backup roll arbor 20 which is shown along its central longitudinal axis by the curve 28. The curves $F_3$ and $F_4$ of FIG. 2 when compared with the curves $F_1$ and $F_2$ of FIG. 1 serve to illustrate the self-compensating feature of the roll 18 and how the strip contacting surface of the work roll 10 and the strip S is characterized by a substantially uniform rolling load distribution whereas in FIG. 1 it is substantially non-uniform.

The particular profile and axial length of the cavities 24 and 26 for a given rolling mill operation depending on the range of rolling loads, the types and widths of material to be rolled, etc. may be derived by several well known engineering techniques, the cavities illustrated having been determined by a finite element analysis incorporating a software program such as ANSYS supplied by Swanson Analysis.

With reference to the employment of a finite element analysis procedure reference is made to FIG. 3 where the parameters of the cavities at one end of the roll 18 would be involved in determining the desired shape, thickness and length of the cavities are identified and which are obvious from the drawing. Also shown the reference characters $W_1$,---$W_2$,---$W_i$,---$W_n$, are representative of the particular range of strip widths to be rolled.

Figure 3A:
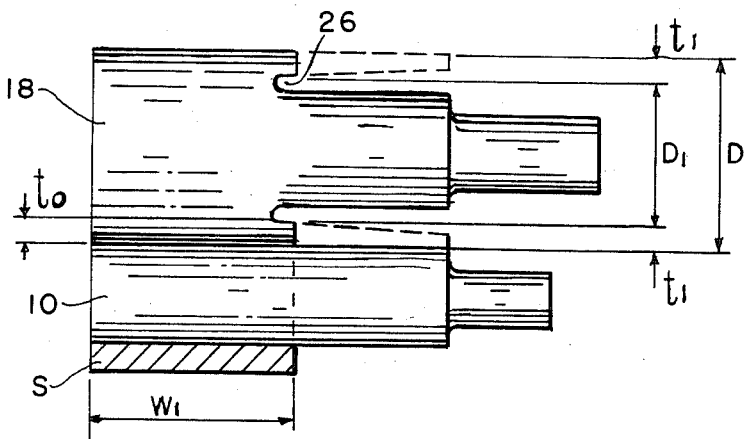

In designing the cavities a brief summary of the use of a finite element analysis is as follows:

With reference to FIG. 3A, consider a narrow strip and a short length sleeve 22 of the cavity portion of the backup roll 16. It will be noted both have the same width $W_1$. By utilizing the finite element analysis, the thickness $t_1$ can be selected so that the deflection of the center and the edge of the strip are the same. Undesirable strip crown is eliminated under this condition.

Figure 3B:
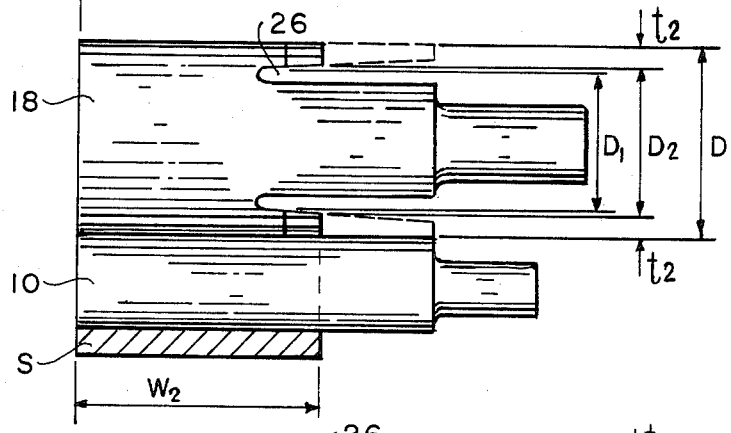
Figure 3C:
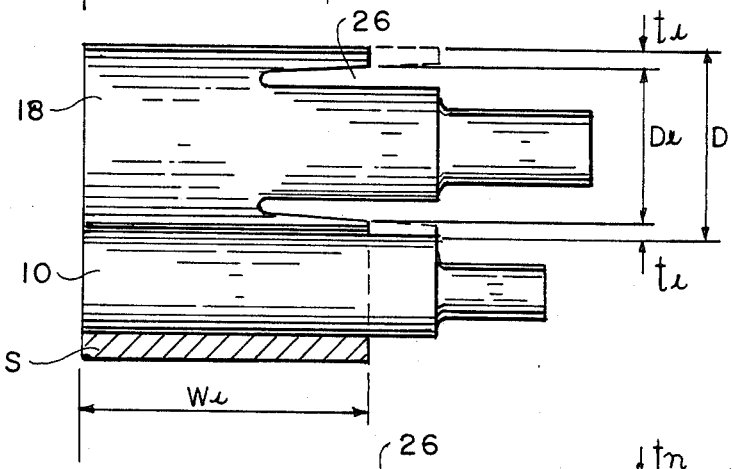
Figure 3D:
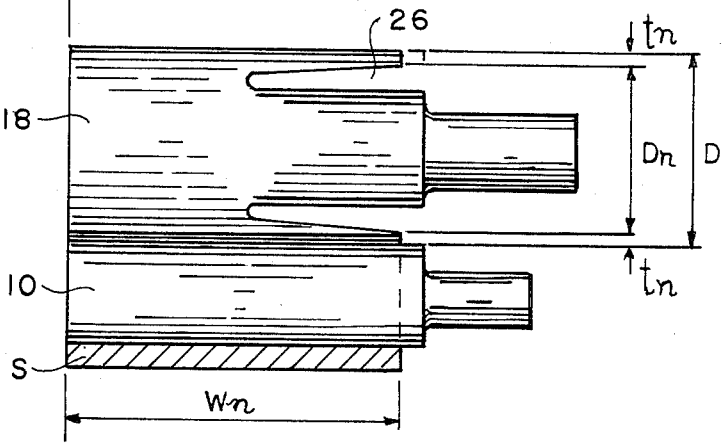

With reference to FIG. 3B the strip width has increased to $W_2$, and so does the length of the cavity portion of the sleeve of the backup roll. The thickness $t_2$ can be determined so that the strip crown is zero as in case $W_1$. Following the same procedure as in FIG. 3C and D, the thickness distribution of the sleeve ---$t_1$, ---$t_n$ can be solved sequentially.

Using this particular constructed backup roll, one can recalculate strip profile for different strip widths of a particular mill.

Referring to FIG. 4, there is shown at the end of the arbor an angular stop member 30 located in one of the cavities which member can be shrunk fit on the arbor and made of a rigid material such as steel. The stop member is designed to limit the movement of the extreme end of cavities 24, 26 in case an overload condition should occur which could otherwise damage the cavity portions of the sleeve 20. Abutting the stop member and extending in radial direction there is a gasket member 32 which is also suitably fitted on the arbor. The gasket member limits the amount of dirt and other foreign matter. Similar members will be provided for the other cavity.

In some rolling mill applications, in particular those required to cover a very wide range of rolling loads as produced for example by a wide range of widths of strips to be rolled, full advantage of the present invention can be best utilized by employing some form of roll bending, preferably work roll bending of the type well known in the art. One of the advantages of the present invention over other known roll constructions designed to reduce roll deflections is that the present invention substantially decreases the amount of roll bending correction needed, whereas with the other known roll constructions, since the rolling loads have the effect of substantially reducing the rigidity of the roll, a substantial amount of correction for roll deflection must be performed by roll bending. In the present invention the ability of the roll to obtain at least a substantially "flat" rolling surface reduces the correction responsibilities of roll bending, indicated in FIG. 2 by two-way arrows 34, to the very minimal as represented by machine or operating maintenance errors that were not accounted for in the engineering of the profile and length of the cavities.

In accordance with the provisions of the patent statutes, We have explained the principles and operation of our invention and have illustrated and described what we consider to represent the best embodiment thereof.

We claim:

1. In a rolling system employed to reduce various widths of strip-like material, comprising:

a work roll for applying a rolling load to said material through a contacting surface, a backup roll for said work roll having a resistance to bending substantially greater than said work roll and being subject to non-uniform rolling load distribution during rolling, said backup roll having an outer contacting surface a generally cylindrical body with a substantially solid interior axial portion and an outer peripheral portion and supported at roll necks extending axially from said body portions forming an open both said portions forming an open air cavity at each end of said body which extends axially along said outer peripheral portion in said solid interior portion, and a rigid contact length in the mid region of said backup roll extending between and adjacent to said each cavity, the cross sectional incremental thickness of a wall of said each cavity along its axial length progressively decreasing from said mid region of said backup roll outwardly to said each end of said backup roll, and said each incremental thickness of said wall of said each cavity being such that said contact length between said solid axial portion and said outer peripheral portion progressively increases and the length of said each cavity progressively decreases with an increase in rolling load and/or with an increase in the width of said rolled material to thereby produce a substantially uniform rolling load distribution across the length of said outer surface said backup roll contacting said work roll resulting in a substantially uniform flat rolled material.

2. In a rolling system according to claim 1, wherein said backup roll further comprises a stop member located in the outermost portion of said each cavity to prevent a given deflection of an axially outermost portion of said outer peripheral portion toward said solid axial portion of said backup roll.

3. In a rolling system according to claim 1, wherein said backup roll further comprises a sealing means located in the outermost portion of said each cavity to prevent external foreign matter from entering therein.

4. In a rolling system according to claim 1, wherein the progressive inner greater thickness increments of said wall of said each cavity compensate for deflections corresponding to narrow width distribution of load conditions caused by said rolled material and progressive outer lesser thickness increments of said wall of said each cavity compensate for designated progressive wider width distribution of load conditions caused by said rolled material.

* * * * *

UNITED STATES PATENT AND TRADEMARK OFFICE

CERTIFICATE OF CORRECTION

PATENT NO. :4,722,212

DATED :February 2, 1988

INVENTOR(S) :VLADIMIR B. GINZBURG and REMN M. GUO

It is certified that error appears in the above-identified patent and that said Letters Patent is hereby corrected as shown below:

Claim 1, column 5, line 1, a comma --,-- should be inserted after "surface";

column 5, line 3, a comma --,-- should be inserted after "portion";

column 5, line 5, a comma --,-- should be inserted after "body", and "portions forming an open" should be deleted;

Signed and Sealed this

First Day of October, 1991

*Attest:*

*Attesting Officer*

HARRY F. MANBECK, JR.

*Commissioner of Patents and Trademarks*